US011383510B2

(12) United States Patent
D'Annunzio

(10) Patent No.: US 11,383,510 B2
(45) Date of Patent: Jul. 12, 2022

(54) INKING SYSTEM WITH MINIMAL INK STORAGE

(71) Applicant: BOBST FIRENZE S.R.L., Campi Bisenzio (IT)

(72) Inventor: Federico D'Annunzio, Florence (IT)

(73) Assignee: BOBST FIRENZE S.R.L., Campi Bisenzio (IT)

( * ) Notice: Subject to any disclaimer, the term of this patent is extended or adjusted under 35 U.S.C. 154(b) by 0 days.

(21) Appl. No.: 16/648,165

(22) PCT Filed: Sep. 21, 2018

(86) PCT No.: PCT/EP2018/025242
§ 371 (c)(1),
(2) Date: Mar. 17, 2020

(87) PCT Pub. No.: WO2019/057341
PCT Pub. Date: Mar. 28, 2019

(65) Prior Publication Data

US 2020/0254753 A1 Aug. 13, 2020

(30) Foreign Application Priority Data

Sep. 22, 2017 (EP) ..... 17020433

(51) Int. Cl.

| | |
|---|---|
| ***B41F 31/02*** | (2006.01) |
| ***B41F 9/06*** | (2006.01) |
| ***B41F 9/10*** | (2006.01) |
| ***B41M 1/10*** | (2006.01) |

(52) U.S. Cl.
CPC ..... *B41F 31/025* (2013.01); *B41F 9/063* (2013.01); *B41F 9/10* (2013.01); *B41F 31/022* (2013.01); *B41M 1/10* (2013.01)

(58) Field of Classification Search
None
See application file for complete search history.

(56) References Cited

U.S. PATENT DOCUMENTS 3,283,712 A 11/1966 Jean

FOREIGN PATENT DOCUMENTS

| | | | | |
|---|---|---|---|---|
| CN | 105346240 | A | | 2/2016 |
| DE | 102004056539 | B3 | | 3/2006 |
| EP | 0659558 | B1 | | 5/1999 |
| GB | 988559 | A | | 4/1965 |
| GB | 1267947 | A | | 3/1972 |
| GB | 1432677 | A | | 4/1976 |
| JP | S5894467 | A | | 6/1983 |
| JP | S5993351 | A | * | 5/1984 |
| JP | S5993351 | A | | 5/1984 |

(Continued)

OTHER PUBLICATIONS

International Search Report dated Nov. 12, 2018, in counterpart PCT/EP2018/025242 (5 pages).

*Primary Examiner* — Joshua D Zimmerman
(74) *Attorney, Agent, or Firm* — Bookoff McAndrews, PLLC

(57) ABSTRACT

The invention discloses an inking system for a rotary printing machine, like a flexographic or rotogravure press. The inking system uses the nip area between two cylinders of the machine as the sole source for inking the printing cylinder. This results in an inking system with very little ink, thereby gaining in reaction time and ink waste.

20 Claims, 5 Drawing Sheets

(56) References Cited

FOREIGN PATENT DOCUMENTS

| | | | |
|---|---|---|---|
| JP | S5993352 | A | 5/1984 |
| JP | S59159350 | A | 9/1984 |
| JP | H08174798 | A | 7/1996 |
| JP | 2002321434 | A | 11/2002 |
| JP | 4841024 | B2 | 12/2011 |
| WO | 7900955 | A1 | 11/1979 |

* cited by examiner

INKING SYSTEM WITH MINIMAL INK STORAGE

CROSS-REFERENCE TO RELATED APPLICATION(S)

This application is a National Stage under 35 U.S.C. § 371 of International Application No. PCT/EP2018/025242, filed on Sep. 21, 2018, which claims priority to European Patent Application No. 17020433.3, filed Sep. 22, 2017, the contents of all of which are incorporated by reference in their entirety.

FIELD OF THE INVENTION

The invention is related to rotary printing machines, like flexographic or rotogravure presses, and in particular to the inking system used in those machines.

TECHNICAL BACKGROUND

A common rotogravure printing unit is made of a gravure cylinder (or printing cylinder) in contact with a second cylinder, which is usually a rubber cylinder, also called the impression roller. The gravure cylinder exhibits a collection of tiny cells on its surface whose distribution defines the image to be printed. These cells are filled with ink which is transferred onto a printing support by contact. The support (paper, cardboard or polymer film) is sandwiched between the printing cylinder and the impression roller.

A common flexographic printing unit is made of an anilox cylinder, which transfers the ink to a cliché carrying cylinder (or printing cylinder) which in turn is in contact with the impression roller. The printing support is, like in the rotogravure case, sandwiched between the printing cylinder and the impression roller. The anilox cylinder is made of tiny cells on its surface whose function is to carry the ink to the printing cylinder.

An inking system is used to fill the cells of an etched cylinder with ink, the etched cylinder being the gravure cylinder of a rotogravure printing unit or the anilox of a flexographic printing unit. A common inking system uses an inking roller (or inking cylinder) to fill the cells, which partially or totally dips into a pan filled with ink, rolls against the etched cylinder and provides the necessary pressure to fill the cells completely. During printing, a doctor blade removes the excess of ink from the surface of the etched cylinder while leaving the ink inside the cells.

The function of the inking roller is to avoid air bubbles inside the cells of the etched cylinder. Another function of the inking roller is to perform a pre-cleaning of the etched cylinder surface, in particular removing the dried ink from the etched cylinder surface. The inking roller is in freewheel in some systems, or is driven by a motor in some other systems; in most cases, the inking roller runs slower than the etched cylinder. The speed mismatch (mismatch in speed direction or amplitude) allows fulfilling the above-mentioned functions.

The existing system with an inking cylinder use an ink pan as a source of ink to the inking system. The use of the ink pan requires that a large amount of ink is used during printing.

The main aim of the invention is about using a minimal amount of ink in the inking system. There are many advantages in using an inking system that uses little ink. For example, the waste generated by an ink change, or by a washing of the cylinder is reduced. Also, the time needed for the ink to travel from the source of ink to the support is reduced, reducing the feedback loop lag in systems that adjust the printing characteristics by monitoring the printed support and changing the ink composition.

U.S. Pat. No. 3,283,712 discloses a system to generate an ink layer on an inking roller with uniform thickness. Despite the fact that their system looks structurally similar to our invention, the functions and properties of the elements at stake are very different. The system is not suitable for inking an etched cylinder, nor for using a minimal amount of ink.

DE 10 2004 056 539 discloses an inking system where the inking is performed in two places: first at the nip between an inking roller and the gravure cylinder, then by dripping the gravure cylinder into an ink pan. The system uses a large amount of ink to wet the gravure cylinder. There is no control of the amount of ink used in the nip.

JPS5993351 discloses an inking system in a nip between an anilox and a rubber roller. The two rollers are configured to turn in opposite directions, pushing the ink downwards. Ink is transported by the anilox through the nip, thereby requiring a bucket to collect the ink surplus below the rollers and a recirculating circuit to recuperate said ink and put it back in the system.

SUMMARY OF THE INVENTION

The invention is implemented by retaining all the ink used for inking in the little space close to the contact line between the inking cylinder and the etched cylinder, which we call the nip area.

The objectives of invention are achieved by the system and method defined in the claims.

In particular, these objectives are achieved by an inking system where an inking cylinder is positioned against the etched cylinder and configured to retain the ink in the area of contact between the two cylinders (i.e. in the nip area). An ink outlet is used to pour the ink either directly or indirectly into the nip area (The ink may be poured onto the inking cylinder and then transported toward the nip area by said cylinder). Also, a system is used to control the level of the ink in the nip area to set and maintain an acceptable amount of ink. The rotation of the inking cylinder may be controlled by a spinning system, for example a motor or a gearing system connected to the etched cylinder. The inking roller is configured to spin in the same direction as the etched cylinder, thereby causing the surface of both cylinders to slide over each other in opposite directions.

Advantageously, a printing unit is provided with a single of such inking system so as to further minimise the amount of ink used for inking.

Advantageously, a doctor blade is positioned on the etched cylinder such that the ink that is removed from the etched cylinder top surface (by the doctor blade) falls back into the nip area without the need of a recirculation circuit.

Advantageously, the inking roller is spun in a direction that causes the ink to be carried toward the nip area. Equivalently, the etched cylinder is spun in a direction that pushes the ink above the nip area.

Advantageously, the nip area is located above the contact line between the inking cylinder and the etched cylinder.

The objectives of the invention are also met by a method, for inking the etched cylinder of the printing unit, that provides ink through the ink outlet to the nip area, spins the inking cylinder in the same direction than the etched cylinder (thereby causing their respective surfaces to slide over each other and bringing and/or retaining the ink in the nip area), and controlling the ink level in the nip area by adding ink when necessary.

DETAILED DESCRIPTION OF THE INVENTION AND OF SOME OF ITS EMBODIMENTS

Figure 1:
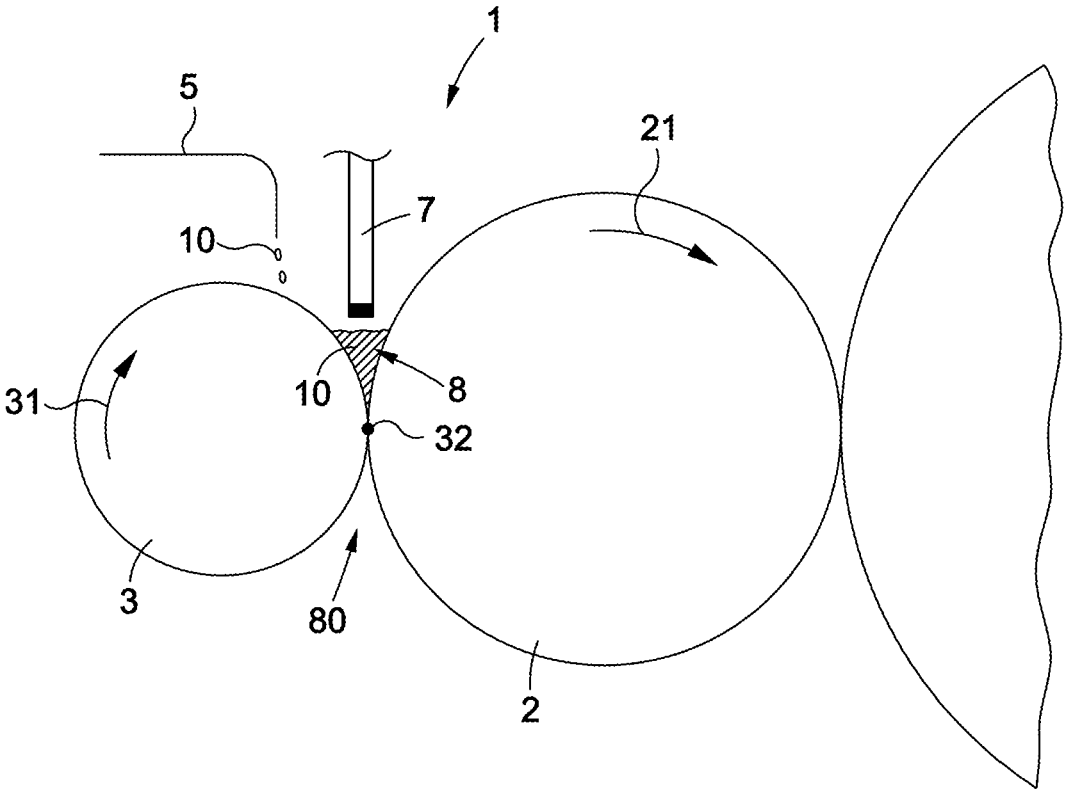
FIG. 1 shows a schematic view of the inking system according to the invention.

FIG. 1 shows the principle of implementation of the invention. The inking cylinder 3 is in contact with the etched cylinder 2. A nip area 8 is formed between the two cylinders (2,3) and is configured to retain the ink 10. The ink is brought through an ink outlet 5 that drops the ink on the inking cylinder 2 or directly into the nip area 8 (or on the etched cylinder). Fundamentally, the ink outlet is configured to drop the ink in a location where the ink ends in the nip area 8 (without going through any ink buffer). A sensor 7 monitors the level of the ink 10 in the nip 8 to ensure a proper inking of the etched cylinder while the printing machine is consuming ink. Advantageously, a system 70 controls the level of the ink 10 in the nip area. Advantageously, the level of the ink is kept as low as possible while ensuring an optimal print quality.

The nip area 8 is defined as the volume between the inking cylinder 3 and the etched cylinder 2 in the vicinity of the contact line 32 where it is possible to retain ink by the sole use of said cylinders (and some side walls and doctor blade(s)). Ink is present in the nip area 8 when the printing machine is running. The contact line is the generatrix of the etched cylinder 2 in contact with the inking cylinder 3 (it is a line located at the top surface of the etched cylinder; the line is parallel to the rotation axis of the cylinder).

Advantageously, the etched cylinder 2 is turning according to direction 21, pushing the ink upwards. In this configuration, the surface of cylinder 2 travels first in an ink free zone 80, then reaches the contact line 32, then reaches the ink 10 in the nip area 8. Finally, the surface reaches the doctor blade 40, then transfers the ink to the next cylinder (or to the printing support) and ends in the ink-free zone 80 again, etc.

Equivalently, the inking cylinder 3 is spun in a direction 31 that pushes the ink 10 toward the nip area (i.e. toward the etched cylinder 2 by first traveling through the nip area). This rotation configuration is illustrated in the FIGS. 4A to 4C. In other words, the inking cylinder 3 is rotated in the clockwise direction when said cylinder 3 is positioned on the left of the etched cylinder 2 (or equivalently in counter-clockwise direction when positioned to the right of the etched cylinder 2). In this way, the ink 10 is retained in the nip area 8 without having to use any blade on the inking cylinder. Also, the ink can be delivered directly on the inking cylinder, which will drive the ink toward the nip area 8. It may also be poured directly into the nip area 8. By directly we mean without using an intermediate buffer, like an ink pan or an ink chamber with a double doctor blade (the ink buffer would defeat the goal of having little ink in the system).

Please note that the air-ink interface in the Figures is represented by an approximately straight line. In practice, it is usually a convex line, whose shape depends on parameters like the rotation speed and the direction of the etched and inking cylinders (2,3), on the ink viscosity and on the friction properties of the cylinder surfaces. Thus, the level 100 of the ink, meaning the height of the ink at a particular location (measured along a line which is not necessarily vertical), cannot be mapped directly to the amount of ink present in the nip area 8, without taking into account said parameters. In practice, however, given a range of rotation speeds and viscosity of the values, a minimal acceptable 101 and maximal acceptable level 102 of ink can be determined by trial and error, by ensuring that the print quality is good and the reactivity of the global inking system is also good if the ink level is comprised between these two boundary values (101,102).

The inking cylinder is driven by a spinning system, which is configured to control the rotation of the inking cylinder 3. The spinning system may comprises a motor which runs independently from the one driving the etched cylinder. The spinning system may also be a mechanical gearing system between the motor of the etched cylinder 2 and the inking cylinder. Said mechanical gearing system imposes a constant speed ratio between the inking and the etched cylinder and is cheaper to implement than by using an additional motor.

In order to ensure an optimal filling of the cells of the etched cylinder with ink, the inking cylinder is configured to slide on the etched cylinder. In other words, the surface of both cylinders travel in opposite directions at the contact line 32. This sliding pushes ink onto the etched cylinder cells. It also cleans the top surface of the etched cylinder, and removes spurious dried ink that might be present on the etched cylinder top surface (in this sense it has a redundant function with the doctor blade, thereby increasing the reliability of the inking against defects caused by dried ink).

The inking cylinder 3 can be rotated, for example, at a speed (amplitude) comprised between 5% and 50% of the rotation speed (amplitude) of the etched cylinder; the rotation speed is measured as the (linear) speed of the cylinder surface. Please note however that the speed amplitude of the inking cylinder 3 can be slower, equal or greater than the speed amplitude of the etched cylinder without affecting significantly the inking quality. Slower speed of the inking cylinder 3 is preferred to limit mechanical wear of the inking cylinder.

Figure 2:
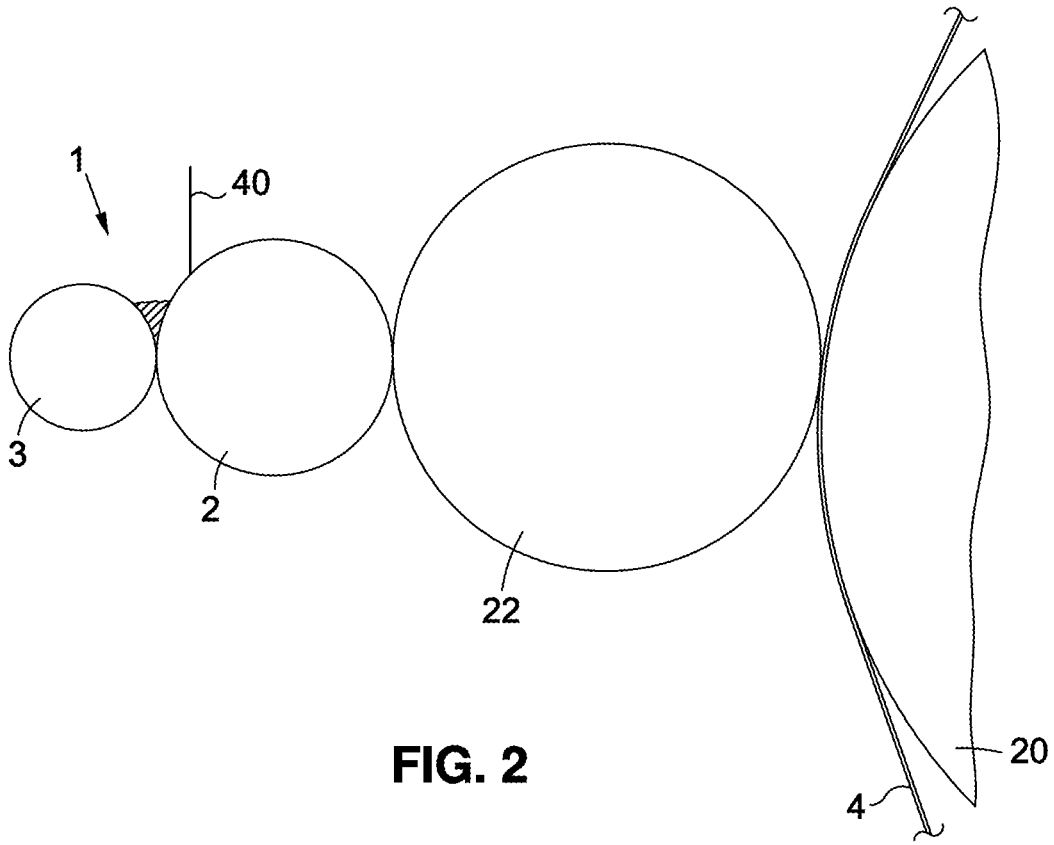
FIG. 2 shows a schematic view of the inking system for a flexographic printing machine where the etched cylinder is an anilox.

FIG. 2 shows how the invention is implemented in a flexographic machine, using the inking cylinder 3 against the anilox 2, which transfers ink to the printing cylinder. The printing cylinder 22 is pressed against the support 4 thanks to the impression cylinder 20 resulting in the cliché being printed on the support.

Figure 3:
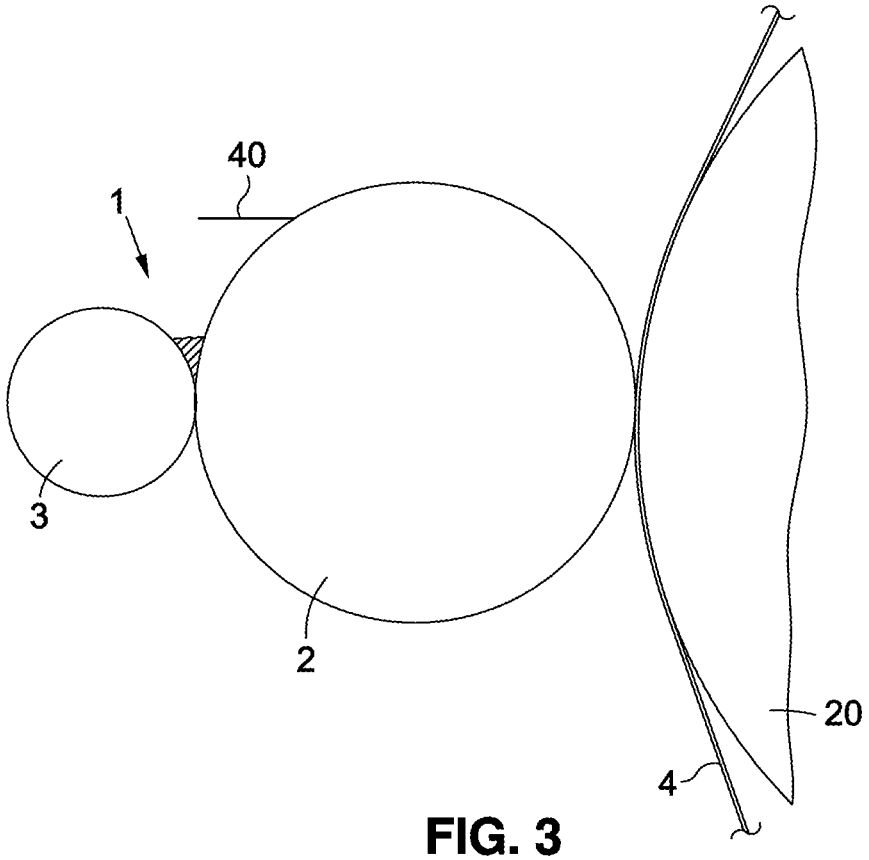
FIG. 3 shows a schematic view of the inking system for a rotogravure printing machine, where the etched cylinder is a gravure cylinder.

FIG. 3 shows how the invention is implemented on a rotogravure printing machine. Compared to the embodiment shown in FIG. 2, the inking system transfers the ink directly into the gravure cylinder, which carries the image to be printed. Thus it uses fewer cylinders, but the inking system can be used in the same way.

Figure 4A:
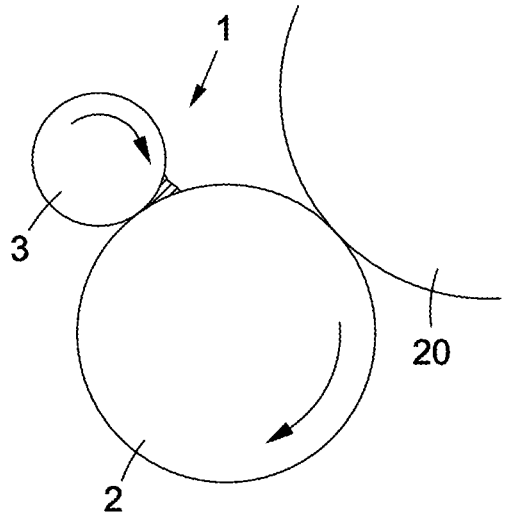
FIGS. 4*a* to 4*c* shows several alternative placements of the inking system compared to the one shown in FIG. 1; We assume that the gravity is directed along the page height.
Figure 4B:
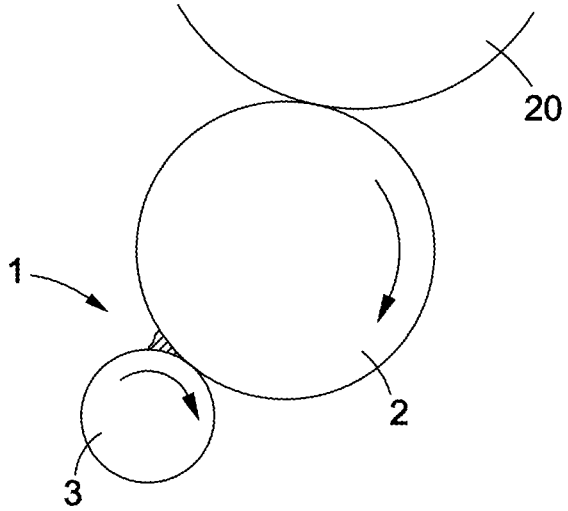
Figure 4C:
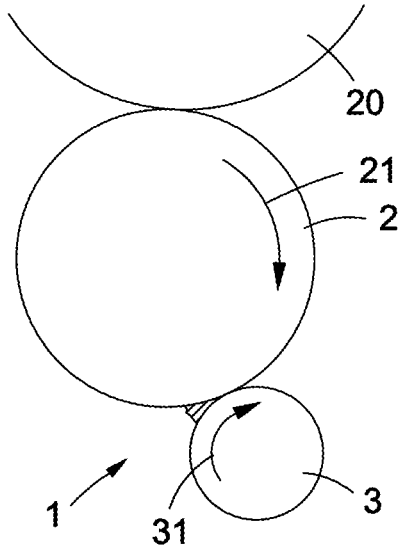

FIG. 4 shows some variations of the position of the nip area 8. FIGS. 4A and 4B show two embodiments where the ink does not leave the nip area from its wide side thanks to the gravity forces (because the nip area is located above the contact line 32). FIG. 4C shows an alternative where the ink is pushed upwards by the inking cylinder thereby preventing it from leaving the nip area from its wide side (the wide side is at the opposite side of the nip area compared to the contact line 32). The inking cylinder turns in the direction 31 as shown in the figures to retain the ink. As mentioned in the summary of the invention, embodiments 4A and 4B are preferred over embodiments 4C which is more delicate to control.

Figure 5:
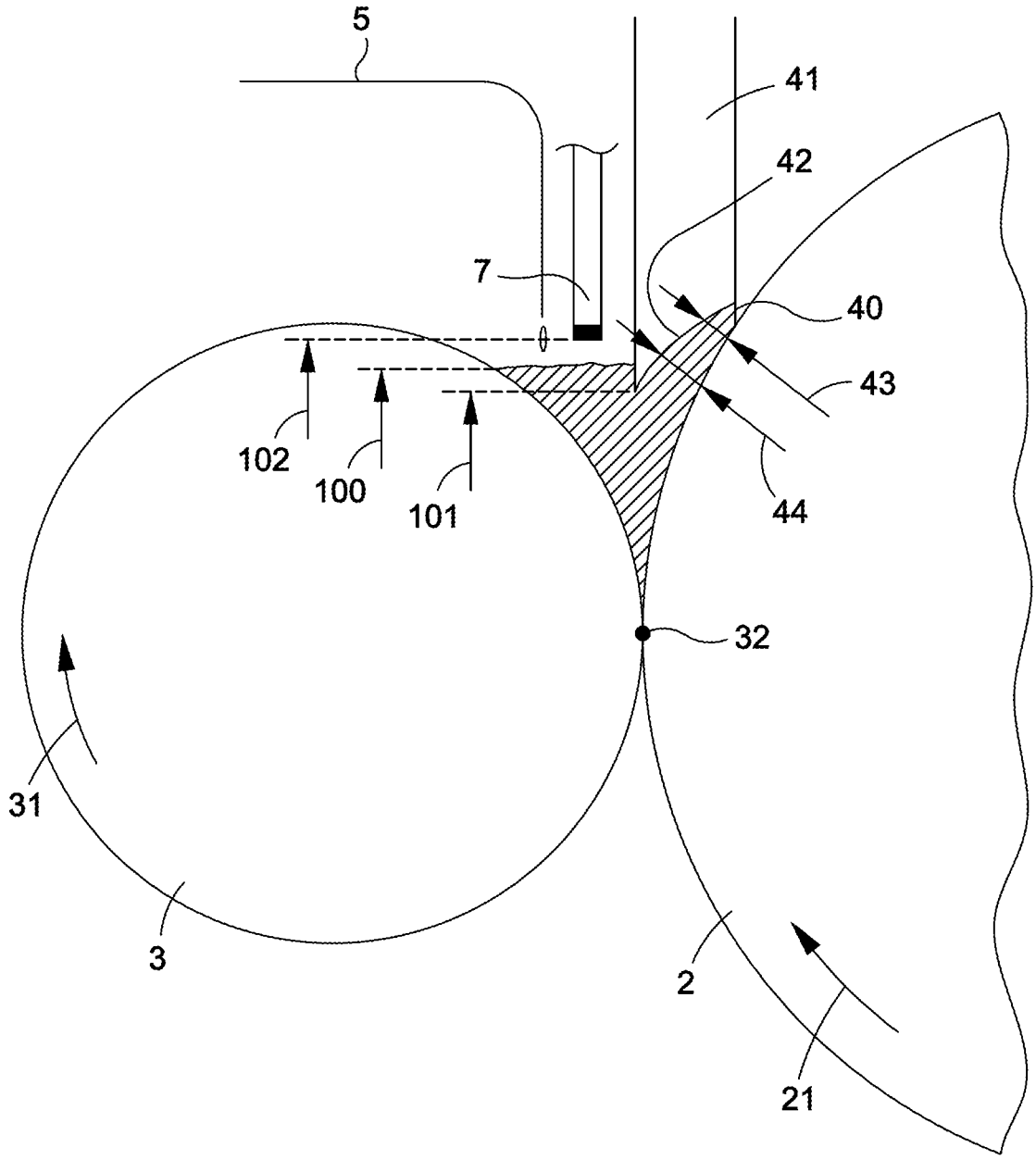
FIG. 5 shows a detailed view of the ink level setting and of the doctor blade assembly, as well as the pinched canal toward the doctor blade.
Figure 6:
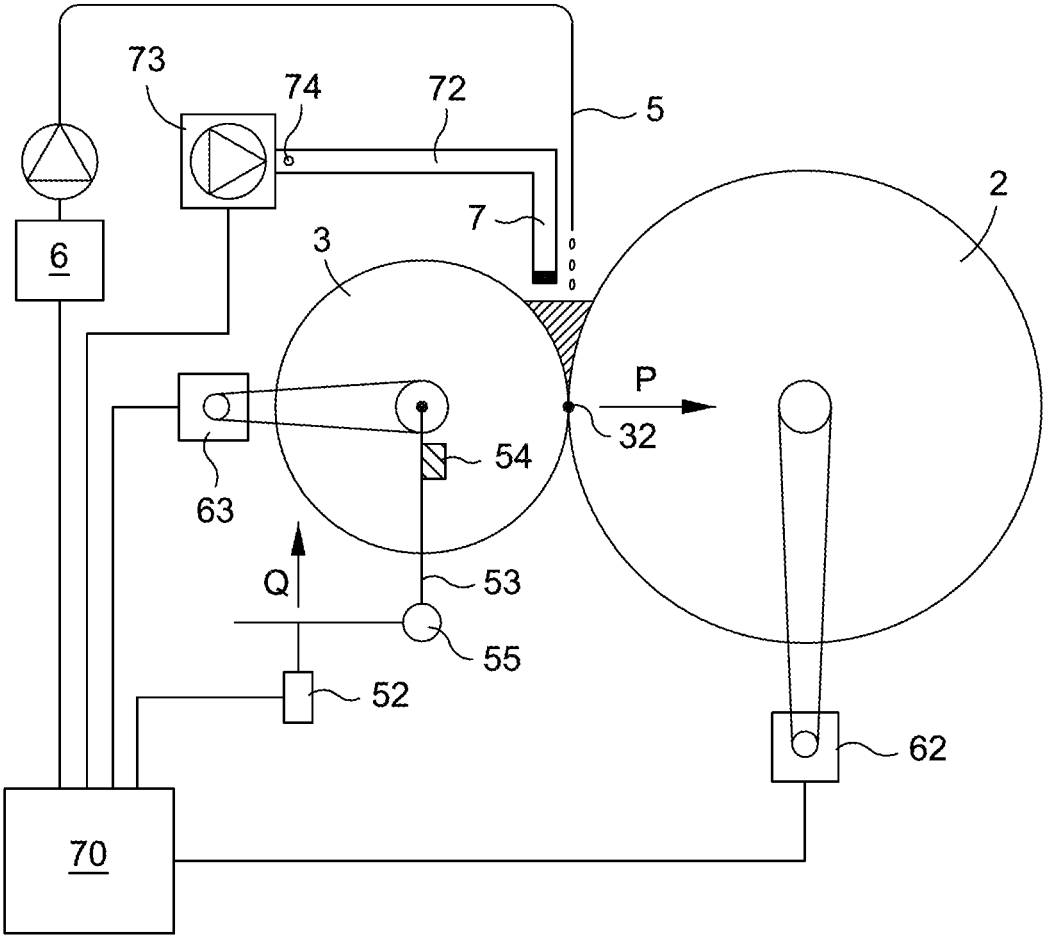
FIG. 6 shows the inking system as a block diagram with the connections to the control system.

FIG. 5 shows a detailed view of an embodiment according to the invention. In this embodiment, there is a pinching device 41 holding the doctor blade 40. The pinching device exhibits a surface 42, whose distance (43,44) to the etched cylinder reduces when approaching the doctor blade. At the entrance of the device, the distance 44 is larger than the distance 43 close to the doctor blade. This pinching surface 42 creates a compression which pushes the ink into the etched cylinder cells, to fill the cells that did not get filled at 100% when passing the contact line 32. As an example, the distance 44 may be set to 3 mm and the distance 43 to 1 mm.

Optionally, the pinching device can also be configured to define the minimal level 101 of the ink present in the nip area. Here, keeping the ink above level 101, i.e. above the inlet to the pinching area, ensures that there is no air introduced underneath the pinching surface (in practice a control system would take a margin in order to ensure that the level never goes below level 101). The sensor 7, which measures the ink level, can be placed next to the pinching device. It may be positioned such that its tip is at the maximum level 102 of the ink, when using an air sensor, or positioned more remotely when using optical, ultrasound of capacitive devices.

The doctor blade can also be used without any pinching device. It can conveniently be placed above the nip area such that the ink removed from the etched cylinder 2 surface drops back toward the nip area 8 (the placement of the doctor blade in the embodiment of FIG. 5 exhibits the same advantage).

The sensor 7 used to measure the level of the ink in the nip area can be of various kind. It may be a device that blows air through an air conduct 72, combined with pressure sensor 74 positioned anywhere in the air conduct or in a pump 73 that blows the air into said conduct. The use of the pump 73 is optional if there is a source of compressed air already available in the printing machine. The sensor 7 may be a capacitive device that is sensitive to the proximity of the air-ink interface. It might also be a time of flight sensor, which measures the time for a wave to exit the sensor and bounce back from the air-ink interface. The wave can be an ultrasound wave, a radar wave or an optical wave. In the case of an optical wave, the sensor must be protected from spills of ink (the optical time of flight sensors include direct time-of-flight, range-gated imaging, and phase detection sensors). The advantage in using the sensor that blows air is its self-cleaning capability.

To maintain the ink level 100 in the nip area 8 between two predefined values 101,102 while the printing machine is running, the printing machine has a control system connected to the sensor 7 and to the ink refill system 6. Whenever the ink level 100 approaches the lower value 101, the system activates the ink refill system 6 that provides additional ink through the ink outlet 5, while ensuring that the refill stops before that the level exceeds the upper value 102. As an alternative, the ink refill can also be performed using a constant rate which is adjusted whenever the ink level approaches one of the boundary values 101, 102. Actually, any well-known control technique can be used to maintain the ink level between the two predefined values 101,102, or around a (predefined) average value 100.

To ensure that the inking of the etched cylinder 2 is performed well, the inking cylinder 3 must be in contact with the etched cylinder 2. By contact between two cylinders, we mean that the inking cylinder 3 is pressed against the etched cylinder 2, or that there is a tiny space of a few microns in-between the two, which is set such that the ink does not leak through the nip area. In many cases, if the spacing exceeds 100 microns, then the ink tends to leak between the two cylinders. However, with some viscous inks, the gap can be up to 1 mm without having the ink leaking. A typical setting of the gap is, for example, 10 microns. In any case, when setting the gap to 10 mm (gap adjustable), the ink is flushed between the cylinders. There is a compromise to find between the pressure between the two cylinders and the risk of ink leakage (even if there is a tiny space between the cylinders, there is a pressure caused by the presence of the ink at the contact line 32). The more pressure, the larger the wearing of the cylinders, the larger the power consumption, the smaller the risk of leakage. This compromise is found by trial and error and is ink dependent. In other words, the inking system is suitable for setting the gap between 0 microns and 1000 microns, and is suitable for setting the flushing gap to a larger distance, for example, 5 mm, 10 mm, 20 mm or more. (Technically, the system is even suitable to set the gap to a negative value, thereby having the possibility to set a pressure value determined by the cylinder elasticity or for compensating the wearing of the inking cylinder over time, or for compensating the difference in diameter between two printing cylinders). The inking cylinder is covered with rubber, generic polymers or even metal or plastic depending on the application.

To set the pressure and/or the distance between the inking cylinder, one possible embodiment uses an abutment 54, coupled with a piston 52 and a pivoting arm 53. The goal is to set the pressure to a value P or to set the distance between the two cylinders to a given value by adjusting the position of the abutment 54 and making sure that the pressure Q provided by the piston to the arm at the abutment location is large enough. The pressure is large enough when the arm 53 is kept in contact with the abutment 54 under any normal printing conditions.

The use of a piston and a pivoting arm allows some special operations of the inking system 1. For example, it allows to temporarily create a gap between the inking cylinder 3 and the etched cylinder 2 to cause the leakage of the ink. This ink leakage allows to partially or completely replace the ink 10 in the nip area 8 in a very short amount of time (for example less than 1 second). Replacing the ink in a very short time might be necessary to correct the ink composition in order to achieve a given printing characteristics.

Please note that in order to fulfil one of the main goals of the invention, namely to have the least possible amount of ink present in the inking system, the inking disclosed in this invention is preferably the only one used to ink the etched cylinder. If we would use an additional ink pan, by using a configuration similar to the invention disclosed in DE 10 2004 056 539 FIG. 1, then the invention would lose most of its interest. By using a single inking system that uses the nip area 8, the total amount of ink in the inking system can be easily lower than 500 g per meter of etched cylinder width, is typically lower than 250 g per meter of etched cylinder width, is reasonably around 80 g per meter of etched cylinder width (or smaller than 120 g per meter of etched cylinder width) and can be as low as 40 g per meter of etched cylinder width when having optimal ink characteristics. Please note that, in some difficult situations, one could use two of the disclosed inking systems for a single etched system, which would still result in less ink used compared to the solution using an ink pan.

By total amount of ink in the inking system, we mean the total amount of ink passed the point where the ink is not easily removed without creating waste, or not easily replaced by a new one. It is the amount of ink that must be consumed by the printing system (or discarded) before being replaced by ink with corrected (or different) characteristics. Here, it includes the ink outlet 5 and the ink in the nip area. It excludes any ink reservoir connected to the ink outlet, because, the ink reservoir is designed to be replaced, and the ink inside the reservoir can be easily reused. In a more traditional inking system using an ink pan or an ink chamber with a double doctor blade, the ink in the pan or in the double doctor blade chamber is part of the total amount of ink in the inking system, since it is not easy to remove and replace this ink (without waste) with new ink.

Please note that the invention can be implemented as a retrofit to existing printing machines. To do so, one needs to provide (at least) and inking cylinder, an ink outlet and a sensor to measure the ink level in the nip area created by placing the inking cylinder in contact with the already-existing etched cylinder of the printing machine.

Please note that a printing unit is a part of a printing machine whose function is to print a single colour of a printing job. For example, there might be a printing unit for printing yellow, another for printing black, etc. There exist also printing units that are printing gloss. The final print is obtained by passing the support/paper/web through several printing units in the printing machine.

The invention claimed is:

1. An inking system, for a rotary printing unit, comprising:

an inking cylinder and an etched cylinder arranged to retain ink between them in a nip area, wherein the etched cylinder includes a surface having cells configured to be filled with ink for printing;

an ink outlet configured to provide the nip area with ink;

a sensor configured to measure an ink level in the nip area; and a doctor blade configured to remove the ink from a top surface of the etched cylinder and including a bottom end positioned above the measured ink level in the nip area, wherein the inking cylinder and the etched cylinder are configured to turn in a same rotational direction.

2. The inking system according to claim 1 further comprising a control system functionally connected to the sensor and configured to control the ink level in the nip area.

3. The inking system according to claim 2, wherein the control system is configured to maintain the ink level in the nip area between two predefined values.

4. The inking system according to claim 1, wherein the inking cylinder is configured to rotate in a direction suitable for carrying ink through the nip area toward a point on the inking cylinder nearest to the etched cylinder to fill the cells of the etched cylinder with the ink.

5. The inking system according to claim 4, wherein the etched cylinder is configured to transfer the ink from the inking cylinder to one or more of a printing cylinder or a surface to be printed with the ink.

6. The inking system according to claim 1, further comprising a mechanical system to control the pressure or the gap between the etched cylinder and the inking cylinder.

7. The inking system according to claim 1, wherein the sensor comprises an air conduct that blows air toward the nip area and a pressure sensor to sense the pressure of the air, the air conduct being positioned such that the pressure of the air varies with the level of ink in the nip area.

8. The inking system according to claim 1, wherein the sensor is an optical time-of-flight sensor.

9. A printing unit comprising an inking system as claimed in claim 1.

10. A printing unit having a single inking system, wherein the single inking system is an inking system as claimed in claim 1.

11. A method for inking an etched cylinder, including a surface having cells configured to be filled with ink for printing, using a minimal amount of ink, for a printing unit comprising an inking cylinder kept in contact with the etched cylinder along a contact line and an ink outlet, the method comprising:

providing ink through the ink outlet to a nip area located between the ink outlet and the contact line;

spinning the inking cylinder in a same rotational direction as the etched cylinder to retain the ink in the nip area;

measuring an ink level in the nip area with a sensor;

controlling the ink level in the nip area by adding ink when necessary, based on the measured ink level; and removing the ink from a top surface of the etched cylinder with a doctor blade including a bottom end positioned above the measured ink level in the nip area.

12. The method according to claim 11, wherein the etched cylinder is rotated in a direction that pushes the ink above the nip area.

13. The method according to claim 11, wherein the ink level is set such that the total amount of ink in contact with the etched cylinder does not exceed 500 grams per meter of etched cylinder width.

14. The method according to claim 11, wherein the ink is poured from the ink outlet directly into the nip area or directly onto the inking cylinder.

15. An inking apparatus for a rotary printing unit, the inking apparatus comprising:

an inking cylinder configured to rotate in a rotational direction;

an etched cylinder including a surface having cells configured to be filled with ink for printing, configured to rotate in the rotational direction, and arranged with the inking cylinder to form a nip area configured to retain ink between the inking cylinder and the etched cylinder; and a sensor configured to measure a level of the ink in the nip area, wherein the nip area is provided below a contact line between the inking cylinder and the etched cylinder.

16. The inking apparatus according to claim 15, wherein a surface of the inking cylinder travels in a linear direction opposite to a linear direction traveled by a surface of the etched cylinder at the nip area, the inking cylinder is configured to rotate in the rotational direction to retain a first portion of ink in the nip area, and the etched cylinder is configured to rotate in the rotational direction to move a second portion of ink out of the nip area.

17. The inking apparatus according to claim 15, further comprising:

a doctor blade configured to remove the ink from a top surface of the etched cylinder and including a bottom end positioned above the measured level of the ink in the nip area.

18. The inking apparatus according to claim 15, wherein the inking cylinder is configured to slide on the etched cylinder to push ink into the cells of the etched cylinder and clean the etched cylinder.

19. The inking apparatus according to claim 18, wherein the inking apparatus does not include an ink pan under the nip area to collect ink leaking through the nip area.

20. The inking apparatus according to claim 15, further comprising:

an ink outlet configured to provide ink to the nip area; and a control system configured to control the ink outlet based on the measured level of the ink to thereby control the level of the ink in the nip area.

* * * * *